US007226274B1

(12) United States Patent
Asplin

(10) Patent No.: US 7,226,274 B1
(45) Date of Patent: Jun. 5, 2007

(54) CEMENT SLAB LEVELING APPARATUS

(76) Inventor: Charles Lee Asplin, 3268 Longfellow Rd., Fargo, ND (US) 58102

( * ) Notice: Subject to any disclaimer, the term of this patent is extended or adjusted under 35 U.S.C. 154(b) by 165 days.

(21) Appl. No.: 10/649,391

(22) Filed: Aug. 26, 2003

(51) Int. Cl.
*F04B 23/14* (2006.01)
*F04B 23/08* (2006.01)
*F04B 35/02* (2006.01)

(52) U.S. Cl. ..... 417/203; 417/205; 417/403; 417/900

(58) Field of Classification Search ..... 417/201, 417/203, 205, 206, 900, 401, 403; 91/533; 60/484
See application file for complete search history.

(56) References Cited

U.S. PATENT DOCUMENTS

| | | | | | |
|---|---|---|---|---|---|
| 2,768,815 | A | * | 10/1956 | Weaver | 366/147 |
| 3,330,211 | A | * | 7/1967 | Faro et al. | 417/361 |
| 3,485,481 | A | * | 12/1969 | Zimmerman | 366/51 |
| 3,801,230 | A | * | 4/1974 | Brown | 417/403 |
| 4,194,726 | A | | 3/1980 | Hance | 254/133 |
| 4,274,559 | A | * | 6/1981 | Menier | 222/217 |
| 4,420,957 | A | | 12/1983 | Weber | 72/1 |
| 4,567,708 | A | | 2/1986 | Haekkinen | 52/743 |
| 4,646,482 | A | | 3/1987 | Chitjian | 51/424 |
| 4,839,969 | A | | 6/1989 | Hahn | 34/169 |
| 4,850,752 | A | | 7/1989 | Carey-Yard | 406/153 |
| 4,878,320 | A | | 11/1989 | Woodson | 51/320 |
| 4,962,913 | A | | 10/1990 | Stewart | 254/269 |
| 5,081,799 | A | | 1/1992 | Kirschner et al. | 51/410 |
| 5,083,402 | A | | 1/1992 | Kirschner et al. | 51/319 |
| 5,141,363 | A | * | 8/1992 | Stephens | 405/150.1 |
| 5,230,185 | A | | 7/1993 | Kirschner et al. | 51/410 |
| 5,239,788 | A | | 8/1993 | Woodson | 51/436 |
| 5,325,638 | A | | 7/1994 | Lynn | 51/320 |
| 5,336,052 | A | * | 8/1994 | Zollner et al. | 417/20 |
| 5,577,446 | A | | 11/1996 | Perry et al. | 104/2 |
| 5,634,574 | A | * | 6/1997 | McArthur et al. | 222/334 |
| 5,860,763 | A | | 1/1999 | Asplin | 404/78 |

* cited by examiner

*Primary Examiner*—Charles G. Freay
(74) *Attorney, Agent, or Firm*—Curtis V. Harr

(57) ABSTRACT

A concrete slab leveling apparatus is provided that is built upon a vehicle such as a flatbed truck or trailer which makes it highly transportable enabling the invention to move from site to site quickly and easily. The flatbed platform of the vehicle is equipped with a material bin which is a relatively large opened topped box which holds the material that is to be pumped under a settled concrete slab. The material bin is also fitted with an auger that extends the length of the lower surface and is a screw-like device which is rotationally driven to move the material contained within the bin towards the front of the auger channel during operations so that it can be moved efficiently into the pump assembly. The present invention is also equipped with a hydraulic pump assembly which drives the fill material from the material bin and through a hose to the proper location under a concrete slab.

16 Claims, 5 Drawing Sheets

FIG 3
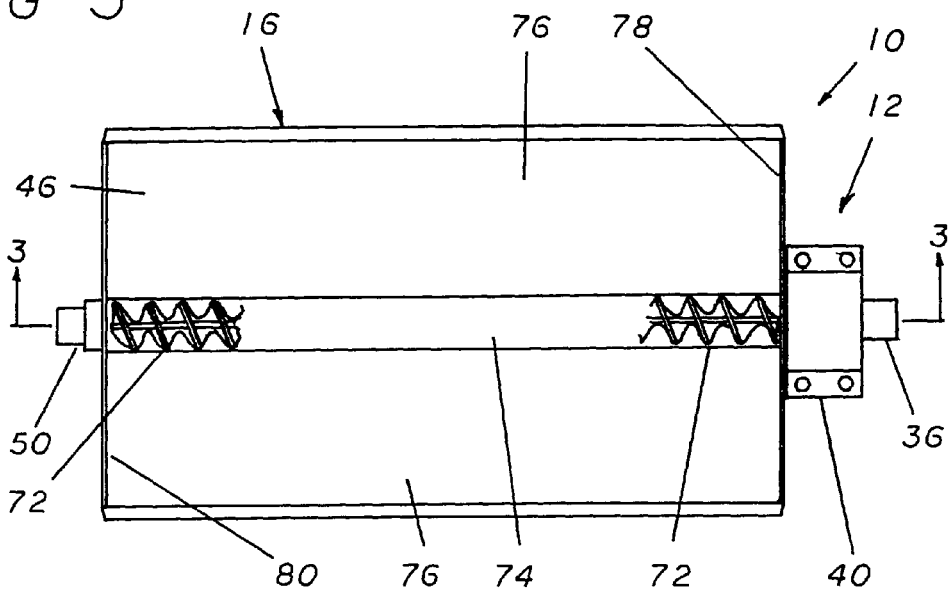
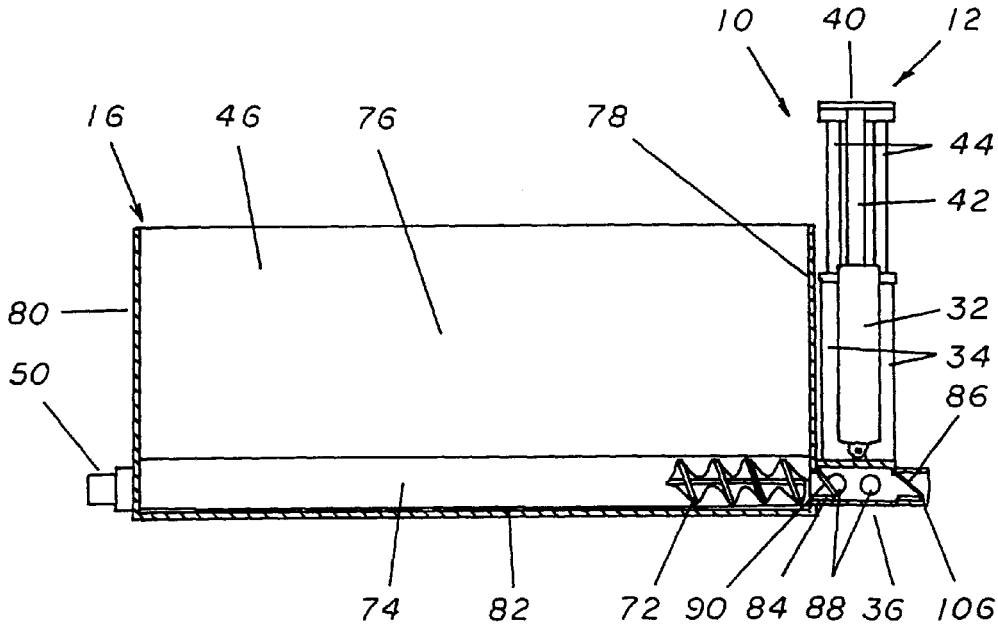
FIG 4

FIG 5
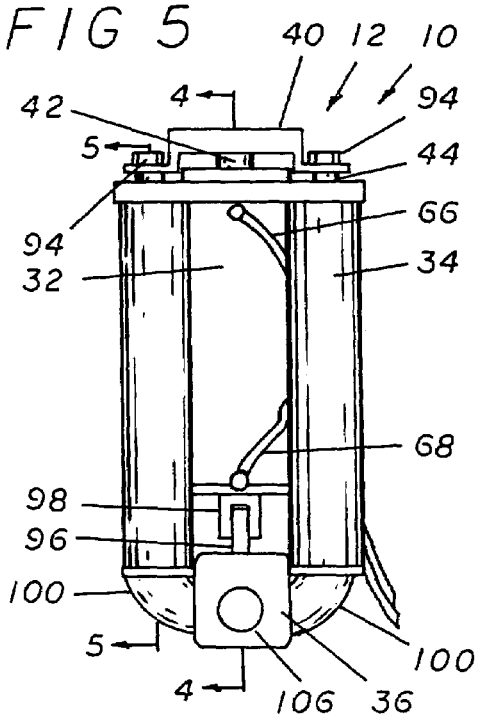
FIG 6
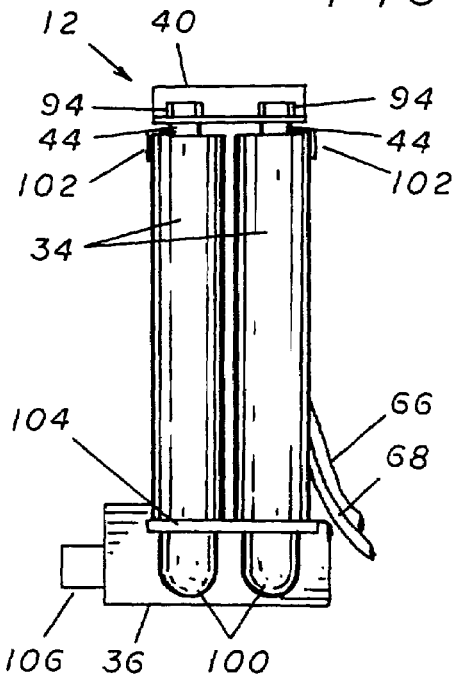
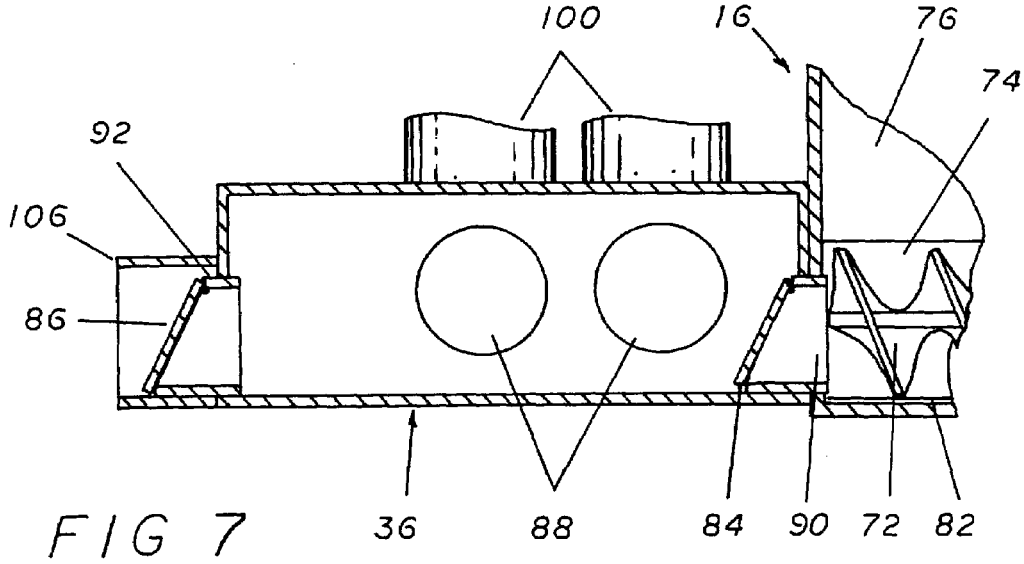
FIG 7

CEMENT SLAB LEVELING APPARATUS

BACKGROUND OF THE INVENTION

The present invention relates to a mechanism which provides a means of leveling an existing sidewalk or other concrete slab or grade which has had portions settle into the ground so as to become uneven over time. More specifically, to a mechanism by which a section of sunken concrete slab or sidewalk can be quickly and easily raised to its original position in a manner that does not damage it and allows for the injection of pressurized sand into the cavity created between the bottom of the uneven concrete slab and the settled ground.

Regardless of the care and skill used in the initial construction, sidewalks and other similar concrete slabs tend to become misaligned over time due to different rates of settlement of the earth. Uplift from freeze/thaw cycles or tree root lifting are also common causes of this slab misalignment. These problems cause cracks in the sidewalk to develop and can also cause step-like structures to occur between sections of the sidewalk. The end result of this condition is the creation of hazards to sidewalk users and liability for those who are responsible for their care, both of which are exacerbated by the fact that the resulting uneven surfaces are extremely difficult to clear of snow and ice during the winter months in the northern areas of the United States.

In the past, there was a number of ways these problems were solved. One of these was to completely remove the damaged section of concrete slab and then re-pour it. The problem with this method is that although it works very well, it is time consuming and expensive. The re-pour method also results in a checkerboard looking concrete slabs as the new portions are often a very different color from the older weathered sections. Another method that has been used with the step formation problem is to construct concrete or tar ramps from the lower section of the sidewalk to the upper. The problem with this method is that it still leaves uneven sidewalk surfaces that are hazardous and difficult to maintain.

A further method of leveling these settled concrete slabs was to remove the soil from the edges of the slab and inserting a mechanical or hydraulic jack underneath it. Once the jack is thus positioned, the settled concrete slab is raised back into its original position by the activation of the jack and processed sand is pumped into the created void. The problem with this method of slab repair is that it is very time consuming, expensive, and inaccurate. Additionally, the removal of the dirt, grass, and other ground related items leaves unsightly scars at the repair sight that can take many months to fully recover.

Another method that is often used to repair these settled sections of concrete slabs is known as mud jacking. In this repair method, a hole is drilled through the uneven slab and wet mud is pumped at relatively high pressure under the slab until the slab becomes level. One problem with this method of slab repair is that it requires that the user drills and repairs a large number of unsightly holes in each individual uncracked section of the concrete slab. An additional problem is that the use of wet mud often makes it difficult to effectively level a slab as the mud will settle over time while drying resulting in a finished repair containing the same deficiencies that prompted the need for it in the first place.

More recently, a number of patents have issued that attempt to deal with this problem in an effective and cost efficient manner. In U.S. Pat. No. 4,962,913, Stewart, Oct. 16, 1990, a method of lifting and repairing such damaged sidewalks is provided. The problem with this device is that by nature of its construction, a heavy frame supported four wheels, it is large and cumbersome in operation. Further, this device requires the even lifting of a given slab in only small sections at a time, as one portion of the device rests on an unlifted portion of the sidewalk. In U.S. Pat. No. 4,982,930, Stewart, Jan. 8, 1991, the same inventor attempted to resolve the short comings of his prior art by lightening the frame and removing the wheels. However, the resulting apparatus is still large and cumbersome in its operation. Also, as can be seen by both these solutions, the lifting methods provided block the sidewalk while the repair is in progress. Finally, the prior art does not provide a means by which the large concrete slabs associated with freeways and airport runways can be easily lifted to effectuate the necessary repairs.

Therefore, from the foregoing discussion it can be clearly seen that it would be desirable to provide a means of leveling existing concrete slabs in an inexpensive and effective manner. Additionally, that such a concrete slab leveling device be capable of lifting any size of settled slab from a small piece of sidewalk to a huge section of concrete runway, and finally, it would be desirable that such a concrete slab leveler be capable of providing a long lasting repair that is itself not subject to the problems associated with settling. Furthermore, the present invention also offers other advantages over the prior art and solves problems associated therein.

SUMMARY OF THE INVENTION

It is the primary objective of the present invention to provide a method of repairing sidewalks or other similar concrete slabs that have become uneven and damaged due to settling or other changes in the elevation of the earth upon which they are built.

It is an additional objective of the present invention to provide such a method of repairing slabs which is economical and efficient in operation and is capable of operation in conjunction with concrete slabs varying in size from the relatively small section of concrete sidewalks to the huge concrete slabs that are commonly used in such things as freeways and airport runways.

It is a further objective of the present invention to provide such a method of repairing settled concrete slabs that is highly transportable which enables the users to move it from site to site with very little time being devoted to setup or takedown.

It is a still further objective of the present invention of providing a mechanism to repair settled concrete slabs in such a manner that is not affected by the later settlement issues that affect those provided by the prior art.

These objectives are accomplished by the use of a concrete slab leveling apparatus that is built upon a vehicle such as a flatbed truck or trailer which makes it highly transportable enabling the invention to move from site to site quickly and easily. The flatbed platform of the vehicle provides the point of attachment for the material bin which is a relatively large opened topped rectangular box which holds the material that is to be pumped under the targeted concrete slab. The material bin has an interior that is constructed with downward diagonally oriented sides that form a V-shape. This manner of construction directs any fluid material (the fill) towards the auger channel located at the bottom center of the bin's interior.

The auger channel is an open top trough that extends the length of the lower surface of the bin's interior and which contains the auger itself. The auger is a screw-like device which is rotationally driven by the bidirectional auger motor on the most forward surface of the exterior of the bin. The auger serves two functions in the operation of the present invention. The first of these is to move the material contained within the bin towards the front of the auger channel during operations so that it can be moved efficiently into the pump assembly. The second function of the auger is to keep the material well mixed prior to its use. The bidirectional nature of the auger drive motor is key to this purpose as it allows the auger to be rotationally driven in both directions which enhances its mixing capabilities.

The hydraulic pressure that is necessary to operate the individual components of the invention is supplied by the hydraulic pump connected to a separate power unit. The power unit is most commonly a small internal combustion engine that is mounted to the exterior surface of the material bin. This provides a power source that can be operated independently from an external power supply and which can supply enough force to run the hydraulic pump.

The hydraulic pump is connected by a feeder hose to a reservoir containing reserve hydraulic fluid. The engagement of the hydraulic pump draws the fluid from this reservoir and transfers it under pressure to the hydraulic control manifold through a high pressure line. The control manifold then divides this pressure up to operate both the auger drive motor and the pump assembly (to be more fully discussed below). From these components, the fluid is returned to the reservoir through the control manifold and a series of hydraulic return lines to complete the cycle.

The heart of the present invention is the pump assembly which drives the material (generally a lime sludge herein after referred to as the fill) contained within the bin into the hose used to direct it into the proper location under a concrete slab. This pumping action is accomplished by the use of a plurality of hydraulic type cylinders that are tied together through the use of a pump cap attached to the upper ends of the cylinder's rams. One of these cylinders is hydraulically activated and operated by the hydraulic system as previously described. Thus, as the primary cylinder is expanded through the activation of the hydraulic manifold controls, the ram is forced upwards thereby pushing the pump rod cap upwards. By virtue of the cap's tie to the plurality of operational cylinder rams, the operational cylinders are also expanded.

The expansion of the operational cylinders draws the fill from the material bin into their interiors through the pump manifold. The pump manifold ties the pump to the bin and is equipped with two one-way valves which control the flow of the fill within the invention. The first of these valves, the forward one-way valve, lies between the interior of the bin and the pump manifold and functions to allow the flow of fill into the manifold as the cylinders are expanded. Conversely, in this operation the rearward one-way valve lies between the pump manifold and its outlet the manifold pipe and functions to keep fill in the manifold pipe from being drawn back into the pump manifold.

Once the expansion of the hydraulic cylinder is complete and the operational cylinders are full, the hydraulic cylinder is then contracted which forces the fill within the operational cylinders back into the pump manifold. This reversal of flow closes the forward one-way valve thereby blocking the flow of the fill back into the bin and opens the rearward one-way valve allowing the fill to be forced into the manifold pipe and to a delivery mechanism to be forced under a settled section of concrete slab. Additionally, the use of the pump assembly in conjunction with the fill material provides enough pressure at the point of delivery to elevate even the largest concrete slab in common use today.

For a better understanding of the present invention reference should be made to the drawings and the description in which there are illustrated and described preferred embodiments of the present invention.

DESCRIPTION OF THE DRAWINGS

FIG. 3 is a top elevation view of the present invention of FIG. 1 and illustrates the positioning of the auger within the material bin.

FIG. 4 is a side elevation cutaway view of the present invention taken along line 3 of FIG. 3 and illustrates the relationship between the auger and the pump assembly that is pivotal to its operation.

FIG. 5 is a rear elevation view of the pump assembly component of the present invention illustrating the orientation of the hydraulic and operational cylinders in relation to the pump manifold.

FIG. 6 is a side elevation view of the pump assembly component of FIG. 5 illustrating the orientation of the hydraulic and operational cylinders in relation to the pump manifold.

FIG. 7 is a side elevation cutaway view of the pump manifold component of the present invention taken along line 4 of FIG. 5 and illustrates the positioning of the one-way valves contained within its body.

DESCRIPTION OF THE PREFERRED EMBODIMENT

Figure 1:
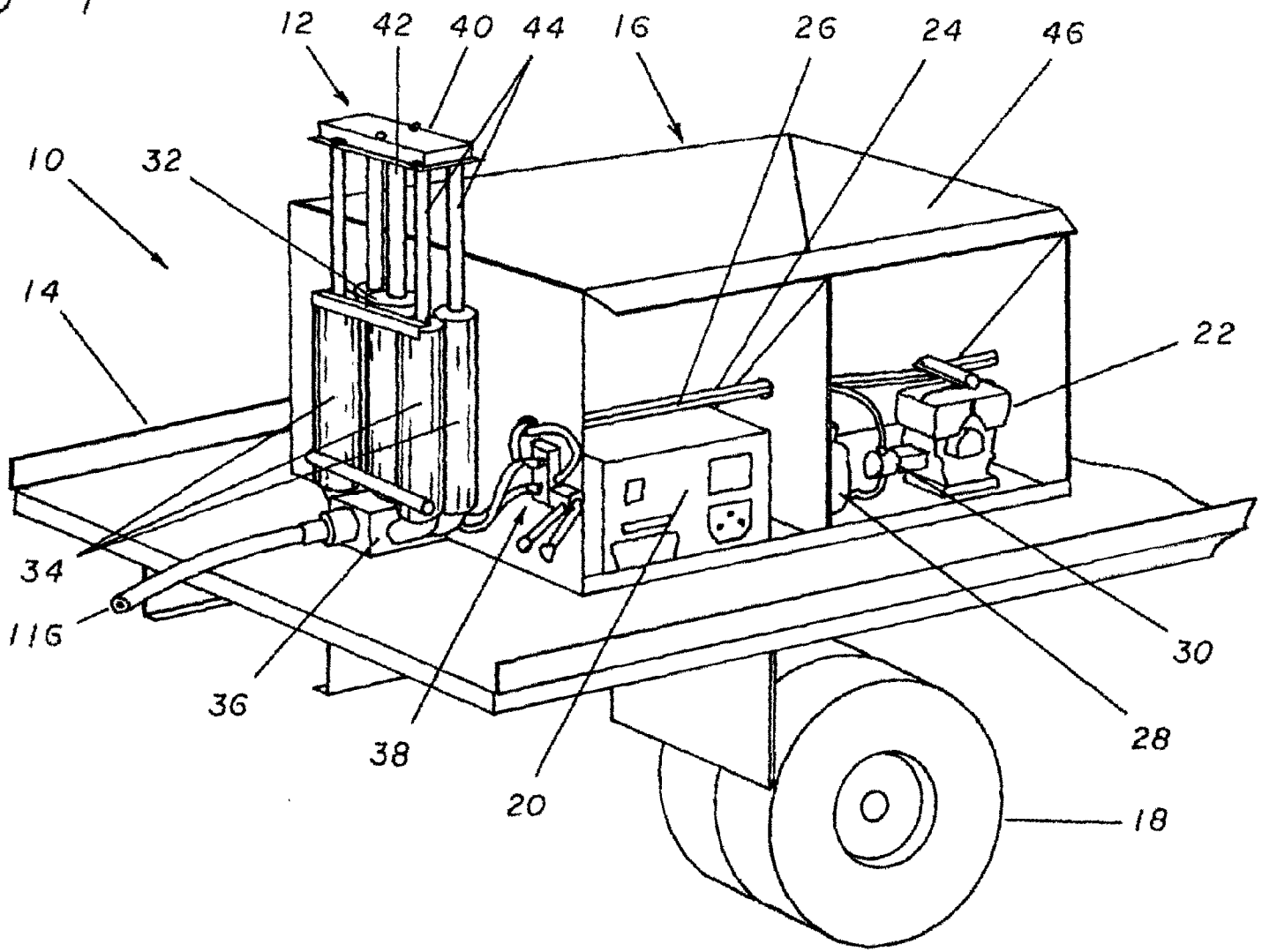
FIG. 1 is a perspective view of the present invention which illustrates its positioning on a flatbed truck and the relative positions of its major components in relation to the flatbed and one another.

Referring now to the drawings, and more specifically to FIG. 1, the slab lift pump apparatus 10 is a self contained portable device that is employed to lift settled concrete slabs in place by pumping at pressure a fill medium between the lower surface of the concrete slab and the upper surface of the ground beneath. The portable aspect of the present invention is accomplished by placing its components on a flatbed 14 vehicle that is equipped with a set of wheels 18 such as a truck or trailer. Additionally, all of the components of the invention that are necessary for its operation are contained on the surface of the flatbed 14 which allows it to easily and quickly moved from site to site and to operate completely independently from any outside device.

The present invention is made up of a large open topped material bin 16 within which the fill material that is used to elevate the targeted concrete slabs is stored during operations. The material bin 16 is represented here as being rectangular in shape (although a plurality of other general configurations are possible) having a bin interior 46 into which the fill is deposited. The rearward surface of the material bin 16 also serves as the mounting point for the pump assembly 12 which is the component of the present invention employed to move the fill from the bin interior 46 to the tool hose 116 and to the targeted area. The components of the pump assembly 12 that are employed in this purpose are the primary hydraulic cylinder 32 and its primary cylinder ram 42, the operational cylinders 34 and their operational cylinder rams 44, the pump ram cap 40, the pump manifold 36, and the hydraulic control manifold 38. All of these components of the present invention will be discussed in greater detail below.

The flatbed 14 also provides a place of securement for the ancillary components of the invention that are necessary for its operation and which allow it to be operated independently. The first of these is the generator unit 20 which is an electric generator that can be employed to power electrical tools such as hand held drills that may be necessary for the lift operation. Additionally, the power unit 22 which is an internal combustion engine that primarily powers the hydraulic pump 30 to which it is attached, is also positioned along the material bin 16 and which draws hydraulic fluid from the fluid reservoir 28 and supplies the necessary hydraulic pressure to the remaining components of the invention through the primary hydraulic pressure and return lines, 24 and 26.

Figure 2:
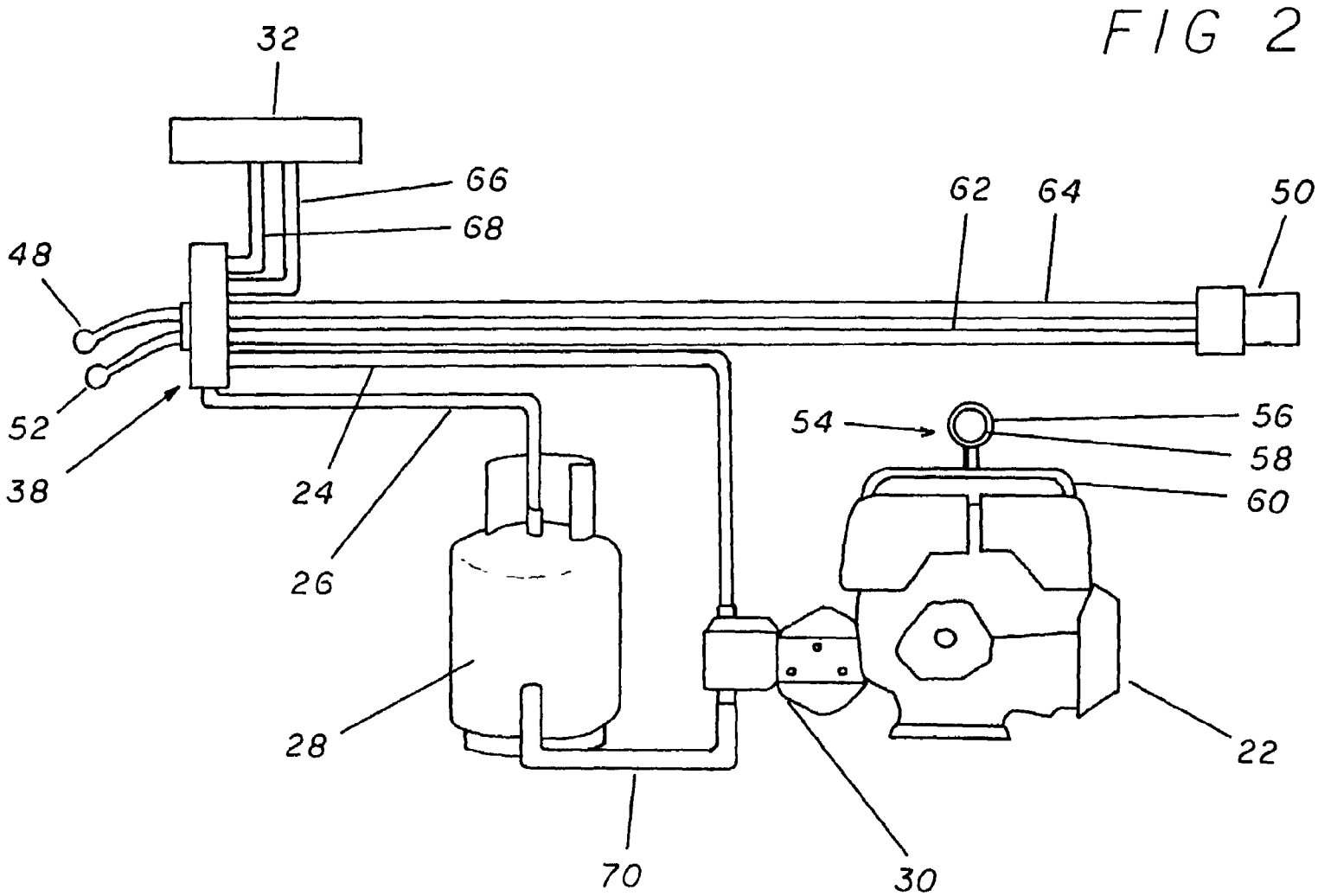
FIG. 2 is a schematic representation of the hydraulic system of the present invention illustrating the manner by which the individual components are tied together and operated by the hydraulic system.

The manner of construction of the present invention's hydraulic system and its relationship to the individual components is further detailed by the schematic diagram of FIG. 2. As previously stated, the power to drive the hydraulic fluid necessary to operate the invention is provided by the power unit 22 which, in the present embodiment of the invention, is a small internal combustion engine. The power unit 22 is mounted to the exterior of the material bin 16 by means of a pivotal mount 54. The pivotal mount 54 is made up of pivot mount tube 56 which slides over a projecting pivot mount post 58 which is in turn fixedly attached to the exterior wall of the material bin 16 and extends therefrom in the horizontal plane. The pivot mount tube 56 has attached to its lower surface a pivot mount bar 60 which in turn attaches to the upper surface of the power unit 22. Thus, the use of the pivot mount 54 suspends the power unit 22 in a manner that allows it to freely pivot without interfering with its operation and without changing its overall orientation with respect to the components to which it is connected. This manner of attachment is important to its operation in that the flatbed 14 is often a dump apparatus allowing it to be tilted during operation of the present invention to ensure that the entire amount of fill can be emptied from the material bin 16. The pivot mount 54 compensates for this by allowing the power unit 22 to maintain its operational orientation regardless of the position of the flatbed 14.

The hydraulic fluid necessary to operate the system is stored and supplied by the fluid reservoir 28 which is connected to the hydraulic pump 30 by the hydraulic feed line 70 which runs from the base of the fluid reservoir 28 to the hydraulic pump 30. The hydraulic pump 30 forces the hydraulic fluid under pressure through the primary hydraulic pressure line 24 which in turn is connected to the hydraulic control manifold 38 mounted on the exterior of the material bin 16. The hydraulic control manifold 38 is used to control the flow of hydraulic pressure to the other operational components of the invention.

In furtherance of this purpose, the hydraulic control manifold 38 is equipped with the hydraulic cylinder control handle 48 and the auger drive control handle 52 which are employed to control the flow of hydraulic pressure to their respective components by opening and closing valves contained within its casing. Therefore, the activation of the auger drive control handle 52 in one orientation supplies hydraulic power through the auger drive pressure line 62 to the auger drive motor 50 which in turn drives the auger 72 in a rotational manner. The hydraulic fluid is then returned to the hydraulic control manifold 38 via the auger drive return line 64. An important consideration in the discussion of this system is that the auger drive motor 50 is a bidirectional device meaning that it is capable of operating in either rotational direction by reversing the flow of hydraulic fluid through it through the use of the auger drive control handle 52. This feature of the auger drive motor 50 allows the auger 72 itself to be reversed in terms of its rotation which can be used to keep the fill well mixed during the operation of the invention.

The operation of the primary hydraulic cylinder 32 (and by incorporation, the pump assembly 12) is also controlled by the hydraulic control manifold 38. The activation of the hydraulic cylinder control handle 48 sends the hydraulic fluid through the primary cylinder pressure line 66 to the primary hydraulic cylinder 32 which is employed to activate it and control its expansion and contraction and therefore, the functions of the pump assembly 12. The fluid loop is completed by the primary cylinder return line 68 which returns the hydraulic fluid to the hydraulic control manifold 38. Finally, the hydraulic fluid from the hydraulic control manifold 38 is returned to the fluid reservoir 28 by means of the primary hydraulic return line 26 to complete the system.

The construction of the material bin 16 and its connection to the associated components of the present invention are further illustrated in FIGS. 3 and 4. As previously stated, the material bin 16 is the component of the invention that is used to hold the fill material during operations and is generally described as an open topped rectangular box having bin forward and rearward walls, 78 and 80, and the two bin diagonal sides 76 defining bin interior 46. The bin diagonal side 76 are both angled inwards from their upper edges at the top of the bin interior 46 to their terminus at the upper most edge of the vertical sides of the auger channel 74 located at the bottom center of the bin interior 46. The auger channel 74 is a relatively square in cross-section component which houses the auger 72 and forms the bottom of the bin interior 46. The primary purpose of the auger channel 74 is to ensure that the fill material contained within the material bin 16 is always in contact with the auger 72 so that it can be moved to the pump assembly 12. The auger 72 itself is a screw-like device which, by the rotational force applied through the auger drive motor 50, is employed to move the fill to the pump assembly 12 and to keep the fill mixed. Additionally, the bin diagonal sides 76 and the auger channel are also lined with a heavy gauge plastic bin liner 82 that helps keep the fill material from sticking to the bin interior 46 and ensuring that it will move down into the auger channel 74.

At the forward end of the material bin 16, the auger channel 74 is connected to the pump manifold 36 of the pump assembly 12 through the manifold inlet 90. This supplies fill to the interior of the pump manifold 36 through the forward one-way valve 84 which is employed to control the flow of fill and which will be discussed in greater detail below. At this point, the hydraulic action of the pump assembly 12 and its components operate to pump the fill to the desired location to effectuate the desired repair.

The construction of the pump assembly 12 is further detailed in FIGS. 5 and 6 which illustrate the configuration of its major components. The central component of the pump assembly 12 is the primary hydraulic cylinder 32 which provides the power to operate the pump assembly 12. The primary hydraulic cylinder 32 is connected at its lower end to the upper surface of the pump manifold 36 by the use of the cylinder mount bracket 96 which is a vertically oriented tab over which the cylinder mount 98 fits. These two components are then tied together to form a pivotal mount for the base of the primary hydraulic cylinder 32. Additionally, the primary hydraulic cylinder 32 is centrally located within the pump assembly 12. This configuration allows the primary hydraulic cylinder 32 to drive the remaining components of the pump assembly 12.

In the present embodiment of the invention, the primary hydraulic cylinder 32 is surrounded by four (4) operational cylinders 34 which are the actual pumping mechanisms employed to force the fill through the system. It is important to note that this configuration is not the only manner in which these components of the present invention can be arranged, in fact, a pump assembly having only two (2) operational cylinders 34 has been contemplated. The primary cylinder ram 42 and the operational cylinder rams 44 extend above their respective bodies and are connected at their upper ends to the pump ram cap 40. The pump ram cap 40 serves to tie the primary cylinder ram 42 and the operational cylinder rams 44 together so that any action imparted to the primary cylinder ram 42 through the primary hydraulic cylinder 32 is then transferred through the operational cylinder rams 44 and their point of connection through the mount nuts 94.

The lower ends of the operational cylinders 34 terminate at the lower base 104 which is in turn connected to the outer surfaces of the pump manifold 36. The connection between the bottom of the operational cylinders 34 at the lower base 104 and the pump manifold 36 is made by an equal number of manifold tubes 100 which are elbow-like devices that join the horizontally oriented lower surfaces of the operational cylinders 34 with the vertically oriented surfaces of the pump manifold 36. Finally, the stabilization of the upper ends of the operational surfaces is facilitated by the use of a pair of upper cylinder brackets 102.

The internal components of the pump manifold 36 are further illustrated in FIG. 7 which detail the connection of the pump manifold 36 to the material bin 16 and the orientation of the forward and rearward one-way valves, 84 and 86. The passage of the fill between the material bin 16 and the pump manifold 36 is facilitated by the manifold inlet 90 which is a short piece of pipe having a diagonally formed rearward edge that is covered by the forward one-way valve 84 which is hinged at its upper most edge. The diagonal surface of the manifold inlet 90 forces the forward one-way valve 84 to lay against and seal off the manifold inlet 90 unless there is an outside force operating against it. Additionally, the most forward end of the manifold inlet 90 opens up at the end of the auger 72 allowing the fill being carried by the auger 72 efficient access to the interior of the pump manifold 36.

The side walls of the pump manifold 36 are also fitted with a plurality of cylinder ports 88 which allow for the passage of fill from the interior of the pump manifold 36 to the operational cylinders 34 through the manifold tubes 100. Rearward of the cylinder ports 88 the pump manifold 36 terminates at the manifold pipe 106 which directs the flow of fill exiting the pump assembly 12. The manifold pipe 106 contains the manifold outlet 92 which is identical in its construction to the manifold inlet 90 and is also sealed off by the use of the rearward one-way valve 86 which also operates in the same manner as the forward one-way valve 84 and regulates the flow of fill out of the interior of the pump manifold 36.

Figure 9:
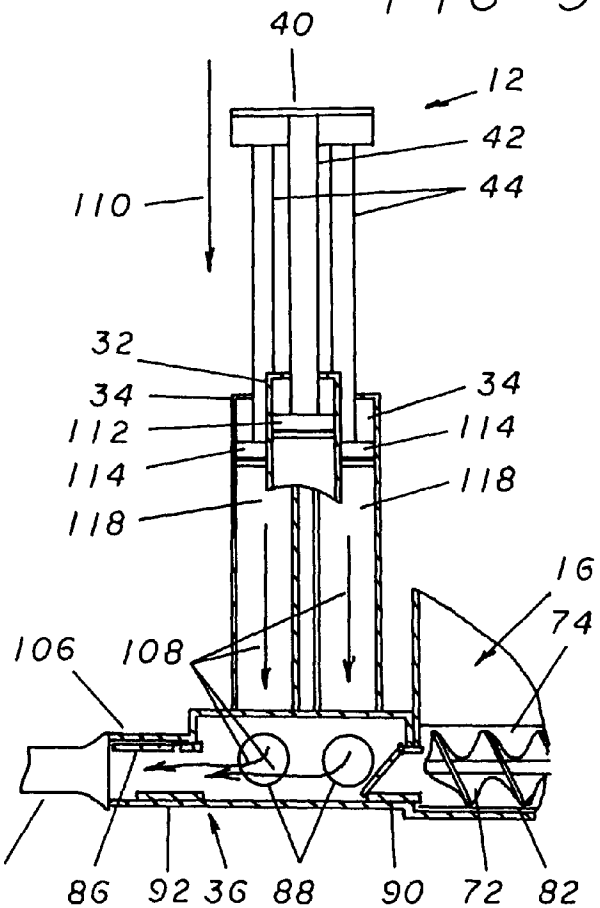
FIG. 9 is a is a side elevation cutaway view of the pump assembly component of the present invention taken along line 5 of FIG. 5 and illustrating the manner by which fill is forced through the manifold and into the manifold pipe during the operation of the invention.
Figure 8:
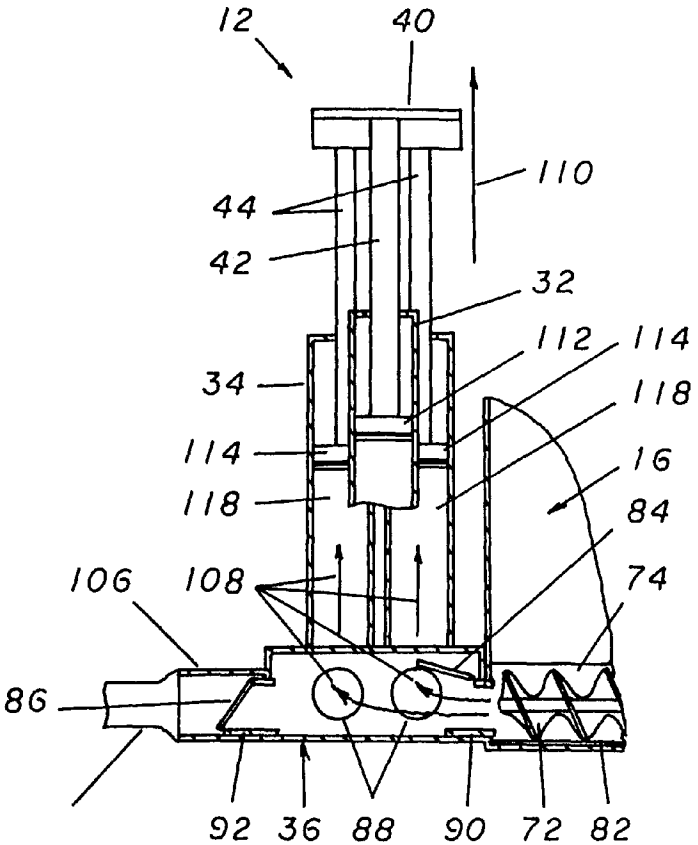
FIG. 8 is a side elevation cutaway view of the pump assembly component of the present invention taken along line 5 of FIG. 5 and illustrating the manner by which fill is drawn from the bin into the pump assembly during the operation of the invention.

The manner in which the pump assembly 12 operates is further illustrated in FIGS. 8 and 9. The expansion of the primary hydraulic cylinder 32 through the hydraulic fluid forcing the internal primary cylinder piston 112 upwards, in turn forces the pump ram cap 40 in a mirroring upward motion defined by the cylinder movement arrow 110. This upward motion of the pump ram cap 40 also pulls up the operational cylinder rams 44 which in turn pulls up the connected operational cylinder pistons 114 contained within the operation cylinders 34. The upward motion of the operational cylinder pistons 114 creates a partial vacuum within the operational cylinders 34 which serves to act on the fill within the system imparting material flow 108 which acts to load up the operational cylinder interiors 118. The material flow 108 also places upward pressure on the forward one-way valve 84 allowing the fill to move into the pump manifold 36. Additionally, the material flow 108 in this configuration places downward pressure on the rearward one-way valve 86 which effectively closes off the manifold outlet 92 which keeps any material rearward of it from being drawn back into the interior of the pump manifold.

Conversely, when the primary hydraulic cylinder 32 is contracted, it pulls the pump ram cap 40 in a downward motion indicated by the cylinder movement arrow 110 which in turn pushes the operational cylinder pistons 114 downward. This downward movement forces the fill contained within the operational cylinder interiors 118 back into the pump manifold 36 as illustrated again by the material flow 108 arrows. The reversal of the material flow 108 has the opposite effect on the forward and rearward one-way valves, 84 and 86. That is to say, the material flow 108 in this configuration places downward pressure on the forward one-way valve 84 sealing off the manifold inlet 90 thereby keeping the fill from being forced back into the material bin 16. Conversely, the material flow 108 opens the rearward one-way valve 86 allowing the fill to exit the pump manifold 36 and enter the tool hose 116 to be delivered in the desired location.

Although the present invention has been described in considerable detail with reference to certain preferred versions thereof, other versions are possible. Therefore, the spirit and scope of the appended claims should not be limited to the description of the preferred versions contained herein.

What is claimed is:

1. A portable mud pumping apparatus comprising:

a material bin having downward sloping sides and a bottom section;

a bidirectional auger in said bottom section of said material bin;

a pump assembly having a plurality of pump chambers each of said pump chambers having a pump ram for drawing mud into each of said pump chambers and pushing said mud out of each of said pump chambers;

a one-way valve assembly connecting said material bin and said pump assembly;

a hydraulic cylinder having a hydraulic cylinder ram; and a pump ram cap fixedly attaching each of said pump rams and said hydraulic cylinder ram such that said pump rams and said hydraulic cylinder ram operate in unison.

2. A portable mud pumping apparatus as in claim 1 further comprising a hydraulic pump connected to said auger and said hydraulic cylinder.

3. A portable mud pumping apparatus as in claim 2 further comprising an engine connected to said hydraulic pump.

4. A portable mud pumping apparatus as in claim 3 further comprising a mud delivery hose connected to said pump assembly.

5. A portable mud pumping apparatus as in claim 4 wherein said apparatus is truck mounted.

6. A portable mud pumping apparatus having a holding bin attached to a mud pump assembly said mud pump assembly comprising:

a plurality of pump chambers, each of said pump chambers having a pump ram extending out of each of said pump chamber;

a primary hydraulic cylinder having a hydraulic cylinder ram extending out of said cylinder;

a pump ram cap fixedly attaching said pump rams and said hydraulic cylinder ram such that said pump rams and said hydraulic cylinder ram operate in unison; and a pump manifold connecting each of said pump chambers to said holding bin.

7. A mud pump assembly as in claim 6 wherein said pump manifold further comprises a forward one way valve that controls the flow of mud from said holding bin into said pump assembly.

8. A mud pump assembly as in claim 7 wherein said manifold further defines a manifold pipe having an attached mud delivery hose.

9. A mud pump assembly as in claim 8 wherein said pump manifold further comprises a rearward one way valve that controls the flow of mud from said pump assembly to said mud delivery hose.

10. A mud pump assembly as in claim 9 further comprising a hydraulic pump attached to said hydraulic cylinder.

11. A portable truck mounted mud pumping apparatus comprising:

a material bin having downward sloping sides and a bottom section;

an auger in said bottom section of said material bin;

a pump assembly having a plurality of pump chambers each of said chambers having a pump ram for drawing said mud into said pump chambers and pushing said mud out of said pump chambers;

a hydraulic cylinder having a hydraulic cylinder ram;

a pump ram cap fixedly attaching said pump rams and said hydraulic cylinder ram such that said pump rams and said hydraulic cylinder ram operate in unison;

a hydraulic pump; and a hydraulic control manifold having a plurality of attached hydraulic lines sodas to interconnect said auger and said hydraulic cylinder and said hydraulic pump.

12. A portable truck mounted mud pumping apparatus as in claim 11 further comprising an engine connected to said hydraulic pump.

13. A portable truck mounted mud pumping apparatus as in claim 12 further comprising a pump manifold connecting each of said pump chambers to said holding bin.

14. A portable truck mounted mud pumping apparatus as in claim 13 wherein said pump manifold further comprises a forward one way valve that controls the flow of mud from said holding bin into said pump assembly.

15. A portable truck mounted mud pumping apparatus as in claim 14 wherein said manifold further defines a manifold pipe having an attached mud delivery hose.

16. A portable truck mounted mud pumping apparatus as in claim 15 wherein said pump manifold further comprises a rearward one way valve that controls the flow of mud from said pump assembly to said mud delivery hose.

* * * * *